US006225796B1

(12) United States Patent
Nguyen

(10) Patent No.: US 6,225,796 B1
(45) Date of Patent: May 1, 2001

(54) ZERO TEMPERATURE COEFFICIENT BANDGAP REFERENCE CIRCUIT AND METHOD

(75) Inventor: Baoson Nguyen, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/602,164

(22) Filed: Jun. 22, 2000

Related U.S. Application Data

(60) Provisional application No. 60/140,617, filed on Jun. 23, 1999.

(51) Int. Cl.[7] ..... G05F 3/16
(52) U.S. Cl. ..... 323/313
(58) Field of Search ..... 323/311, 312, 323/313, 314, 315

(56) References Cited

U.S. PATENT DOCUMENTS

| | | | | |
|---|---|---|---|---|
| 4,110,677 | | 8/1978 | Boronkay et al. | 323/19 |
| 4,603,291 | | 7/1986 | Nelson | 323/315 |
| 4,849,684 | | 7/1989 | Sonntag et al. | 323/313 |
| 5,053,640 | | 10/1991 | Yum | 307/296.6 |
| 5,097,198 | | 3/1992 | Holmdahl | 323/280 |
| 5,325,045 | * | 6/1994 | Sundby | 323/313 |
| 5,327,028 | * | 7/1994 | Yum et al. | 307/491 |
| 5,424,628 | | 6/1995 | Nguyen | 323/314 |
| 5,631,551 | | 5/1997 | Scaccionoce et al. | 323/313 |
| 5,900,772 | | 5/1999 | Somerville et al. | 327/539 |
| 5,952,873 | | 9/1999 | Rincon-Mora | 327/539 |
| 6,023,189 | | 2/2000 | Seelbach | 327/538 |

* cited by examiner

*Primary Examiner*—Peter S. Wong
*Assistant Examiner*—Gary L. Laxton
(74) *Attorney, Agent, or Firm*—J. Dennis Moore; Wade James Brady, III; Frederick J. Telecky, Jr.

(57) ABSTRACT

In one aspect, the present invention provides a method of generating a substantially constant voltage. A bandgap reference circuit (112/114/116) is trimmed such that a voltage output ($V_{BG}$) from the bandgap reference circuit is at its peak value when an operating temperature is at its minimum value within a specified operating temperature range. A plurality of additional current sources (118–124) are also provided with the bandgap reference circuit. Each current source is designed to successively provide additional current as the operating temperature increases within the specified operating temperature range.

5 Claims, 5 Drawing Sheets

ZERO TEMPERATURE COEFFICIENT BANDGAP REFERENCE CIRCUIT AND METHOD

This application claims priority under 35 U.S.C. §119(e) (1) of provisional Application No. 60/140,617 filed Jun. 23, 1999 and incorporated herein by reference.

FIELD OF THE INVENTION

This invention relates generally to electronic circuits and specifically to a zero temperature coefficient bandgap reference circuit and method.

BACKGROUND OF THE INVENTION

Many electronic circuits require a stable and accurate reference voltage for effective operation. Reference voltages, however, may be unstable due to temperature variations caused during circuit operation. To compensate for the temperature dependence of reference voltages, bandgap circuits have been designed to minimize the effect of temperature on the reference voltage. These conventional bandgap circuits compensate for the first order temperature coefficient of a transistor's base to emitter voltage without completely eliminating the temperature dependent characteristics of the circuit. Thus, the base to emitter voltage remains dependent on changing operating and process characteristics.

FIG. 1*a* illustrates a typical bandgap circuit 10. The current source 12 is designed to increase with temperature using the same type of resistivity as resistor 14. In other words, as the temperature goes up, the current will also go up and, as a result, the voltage across resistor 14 will go up. The diode 16, on the other hand, has a negative temperature coefficient. In this case, as the temperature goes up, the voltage across diode 16 will go down. With proper trimming, the circuit 10 can be designed to provide a constant, to the first order, bandgap voltage $V_{BG}$ across both resistor 14 and diode 16.

As illustrated in FIG. 1*b*, the bandgap voltage $V_{BG}$ as function of temperature will not be constant to higher orders. In typical applications, the circuit will be tuned such that it has a zero temperature coefficient at some predetermined temperature $T_0$, typically room temperature (e.g., 25° C.). In some applications, this variation creates issues and therefore it is desirable to correct the higher order effects.

Most techniques used in the past to correct the curvature of the bandgap reference usually vary too much with process and introduce extra errors which are not trimmed out. These techniques limit the performance of the bandgap reference at the best of ±1% specification over the full military (e.g., −50° C. to 150° C.) temperature range.

SUMMARY OF THE INVENTION

In one aspect, the present invention provides a new and improved technique to correct the curvature by breaking the temperature range in smaller ranges and optimizing only the first order temperature in each range successively. The curvature shape becomes, after trimming the first order temperature coefficient, a series of much smaller curvatures connected one after another. A temperature detection circuit provides as many break points in temperature as necessary to minimize the temperature variation of the bandgap reference.

In a first aspect, the present invention provides a method of generating a substantially constant voltage. A bandgap reference circuit is trimmed such that a voltage output $V_{BG}$ from the bandgap reference circuit is at its peak value when an operating temperature is at its minimum value within a specified operating temperature range. A plurality of additional current sources are also provided with the bandgap reference circuit. Each current source is designed to successively provide additional current as the operating temperature increases within the specified operating temperature range.

As a first exemplary embodiment, a bandgap reference circuit includes a first current source, possibly including a current mirror. A first element has a positive voltage temperature coefficient and a second element has a negative voltage temperature coefficient. These first and second elements are coupled in series such that current provided by the current source flows through the first and second elements. The circuit also includes a plurality of additional current sources and a plurality of switches, each switch including a current path between a respective one of the additional current sources and the first and second elements. The switches are controlled by a temperature detection circuit.

BRIEF DESCRIPTION OF THE DRAWINGS

The above features of the present invention will be more clearly understood from consideration of the following descriptions in connection with accompanying drawings in which.

DETAILED DESCRIPTION OF ILLUSTRATIVE EMBODIMENTS

The making and use of the various embodiments are discussed below in detail. However, it should be appreciated that the present invention provides many applicable inventive concepts which can be embodied in a wide variety of specific contexts. The specific embodiments discussed are merely illustrative of specific ways to make and use the invention, and do not limit the scope of the invention.

In one aspect, the present invention provides a voltage reference generation circuit. One goal of the preferred embodiment circuit is to generate a constant voltage, even as the temperature is varied.

Figure 1A:
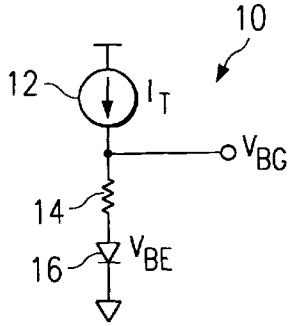
FIG. 1a (PRIOR ART)
FIG. 1*a* illustrates a convention bandgap reference circuit.
Figure 1B:
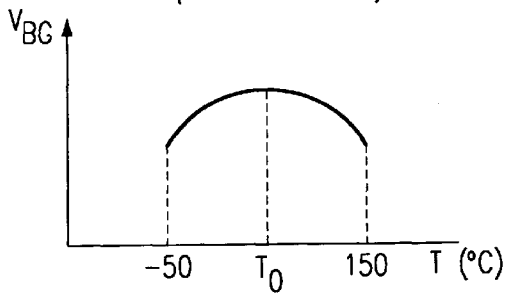
FIG. 1b (PRIOR ART)
FIG. 1*b* illustrates the relationship between bandgap voltage and temperature for a circuit as in FIG. 1*a;*
Figure 2A:
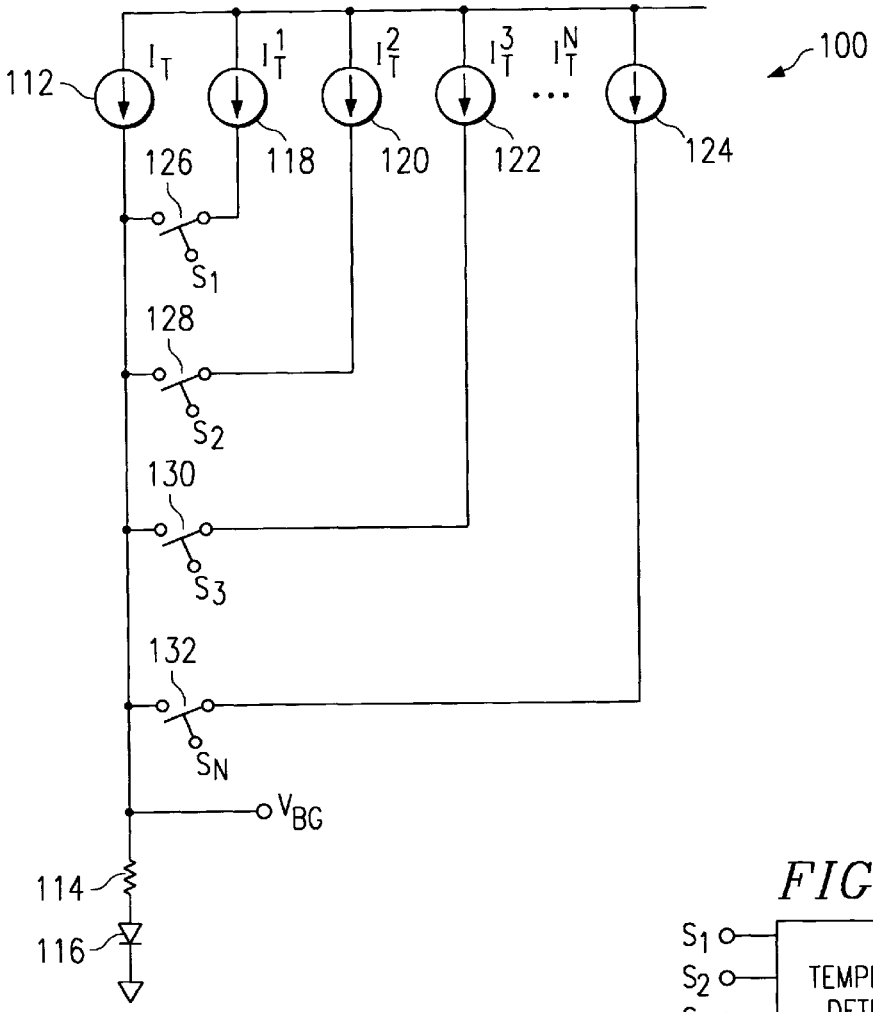
FIGS. 2*a* and 2*b* illustrate a first embodiment circuit of the present invention.
Figure 2B:
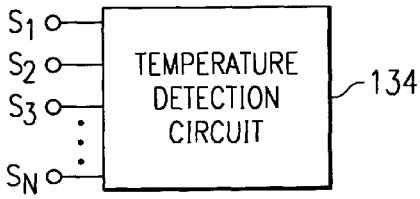
Figure 6C:
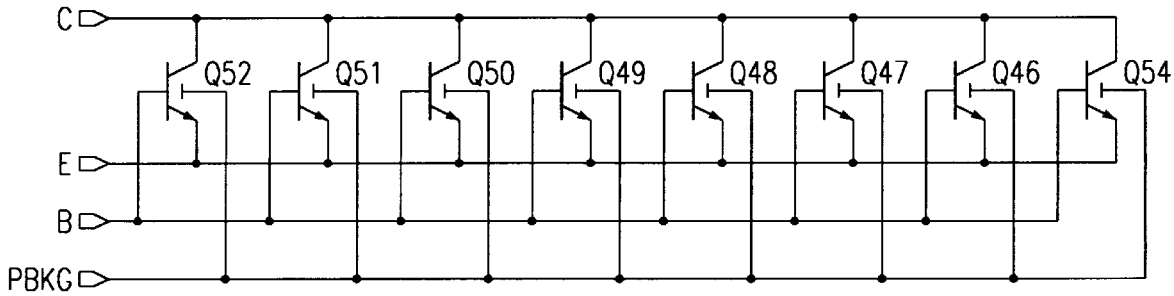
FIGS. 6*a*–6*c* show a third embodiment circuit of the present invention.
Figure 6A:
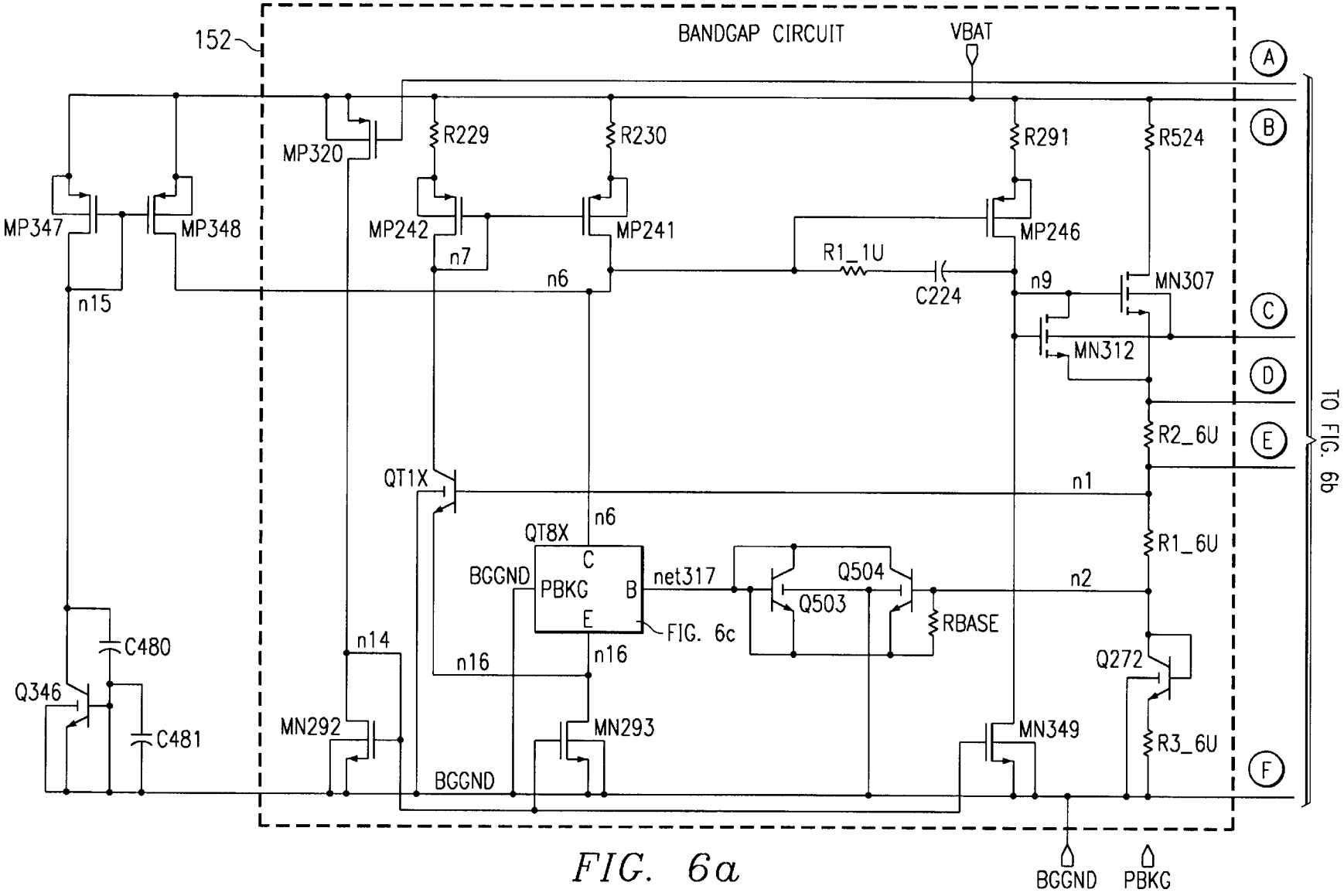
Figure 6B:
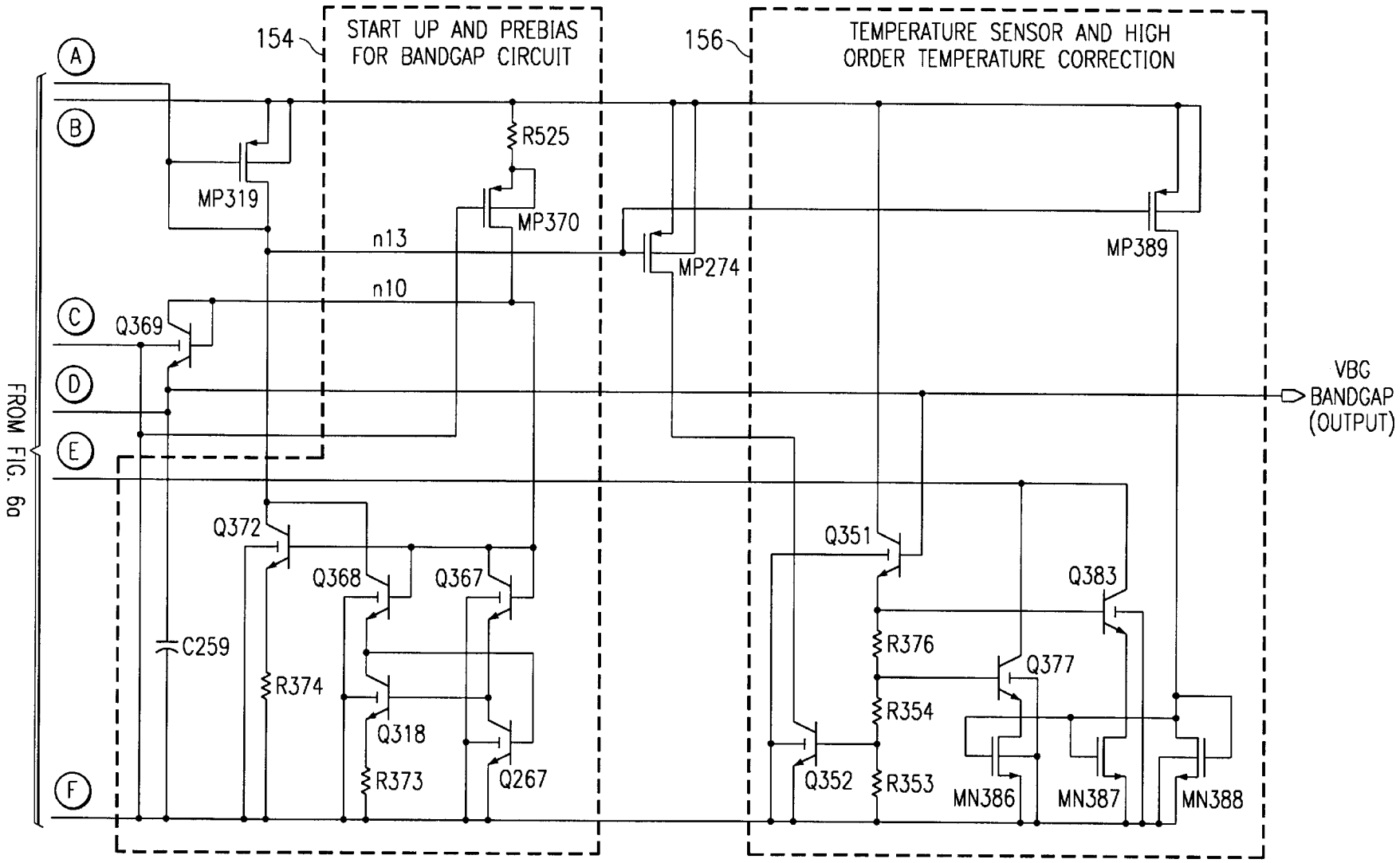

FIG. 2, which includes FIGS. 2*a* and 2*b*, illustrates a first embodiment circuit 100 that can be used to compensate for higher order effects. Current source 112 is coupled in series with resistor 114 and diode 116. In the preferred embodiment, current source 112 can be implemented using a current mirror type arrangement. Resistor 114 can be implemented, for example, with a polysilicon line or semiconductor substrate. In either case, the material will be doped to the appropriate resistivity. Diode 116 can be implemented with a transistor (e.g., a bipolar transistor) connected to act as a diode. FIGS. 6*a*–6*c* provides a specific implementation.

As with conventional bandgap reference circuits, the resistor 114 has a positive voltage temperature coefficient while the diode 116 has a negative voltage temperature coefficient. As a result, the voltage across the two elements will remain constant as temperature change, but only to the first order. In one aspect, it is a goal of the present invention to compensate for higher order temperature effects so that the voltage remains more constant.

To provide for the temperature compensation, the circuit 100 includes a number of additional current sources 118–124. Each of these current sources can be switched to be additive to the current from current source 112. Switches 126–132 provide the switching and are controlled by temperature detection circuit 134. The temperature detection circuit 134 outputs switch signals $S_1$–$S_N$ based on a measured temperature of the device. As a result, as the temperature becomes higher, more current will flow through resistor 114.

In the preferred embodiment, the switch signals $S_1$–$S_N$ are output as a thermometer code. In other words, as the temperature goes up, the switches turn on consecutively without any of the previous switches turning off. Likewise, when the temperature goes down the switches will turn off one at a time.

In other embodiments, codes other than a thermometer code can be used. For example, if current from current sources 118–124 are of varying values, the switches can be manipulated on and off to generate the appropriate current. For example, each source could generate half as much current as another source thereby minimizing the number of current sources necessary to provide the appropriate compensation currents. In a simpler example, only one of the switches would be conducing at a given time. It is noted that in any of these cases it is desirable, although not strictly necessary, that the circuits be designed to avoid discontinuities in the output voltage.

Figure 3A:
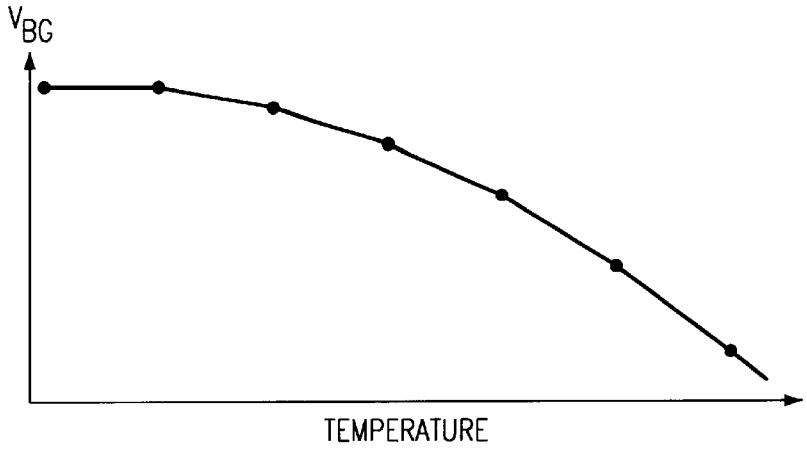
FIG. 3*a* is a plot showing the relationship between bandgap voltage $V_{GB}$ and temperature before compensation.
Figure 3B:
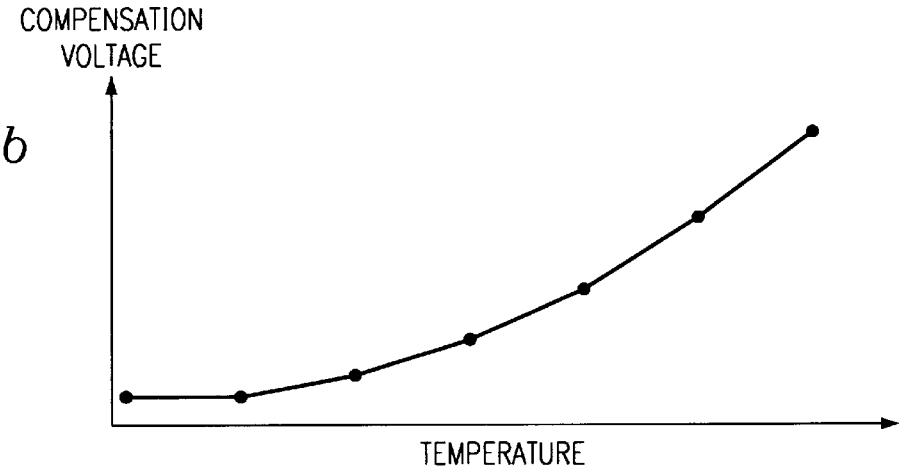
FIG. 3*b* shows the compensation current used to compensate a circuit of the present invention.

FIGS. 3*a* and 3*b* are provided to demonstrate the concept behind this embodiment of the present invention. FIG. 3*a* shows the bandgap voltage $V_{BG}$ as a fiction of temperature for an uncompensated circuit (e.g., a circuit that includes only current source 112, resistor 114 and diode 116). As noted before, this relationship is non-linear when higher order temperature effects are taken into consideration.

It is noted that in the preferred embodiment, the uncompensated circuit is trimmed so that the output of the bandgap reference circuit $V_{GB}$ is at its peak value when the operating temperature is at its minimum value within the operating temperature range. In this context, the operating temperature range is the range of temperatures in which the device is designed to operate within. This temperature range is typically provided in the specifications for a commercially available device. In the preferred embodiment, the operating temperature range is from about −50° C. to about +150° C.

As noted in FIG. 3*a*, the bandgap voltage curve can be approximated in a piece-wise linear fashion to comprise a number of straight lines. In one aspect, the present invention provides a technique to optimize only the first order temperature effects in each range of the bandgap voltage curve. Using this technique, the temperature can be fully compensated by using more break points. In the extreme, an infinite number of breakpoints, each separated by an infinitesimally small temperature, would lead to a perfectly compensated curve. In the preferred embodiment, the voltage curve is approximated between about three and six linear pieces. For example, the presently preferred circuit includes four breakpoints (leading to five linear segments).

FIG. 3*b* illustrates the compensation voltage that is used to eliminate the first order effects for each of the line segments of the approximation in FIG. 3*a*. The compensation voltage is generated by providing additional current through the bandgap circuit thereby causing the voltage to go up.

FIGS. 3*a* and 3*b* illustrate one particular embodiment. Other cases can also be derived. For example, the uncompensated bandgap circuit can be trimmed so that the peak voltage value is somewhere other than the minimum temperature. In this case, additional current will be added whenever the temperature varies either higher or lower than the temperature associated with the peak voltage.

Figure 4:
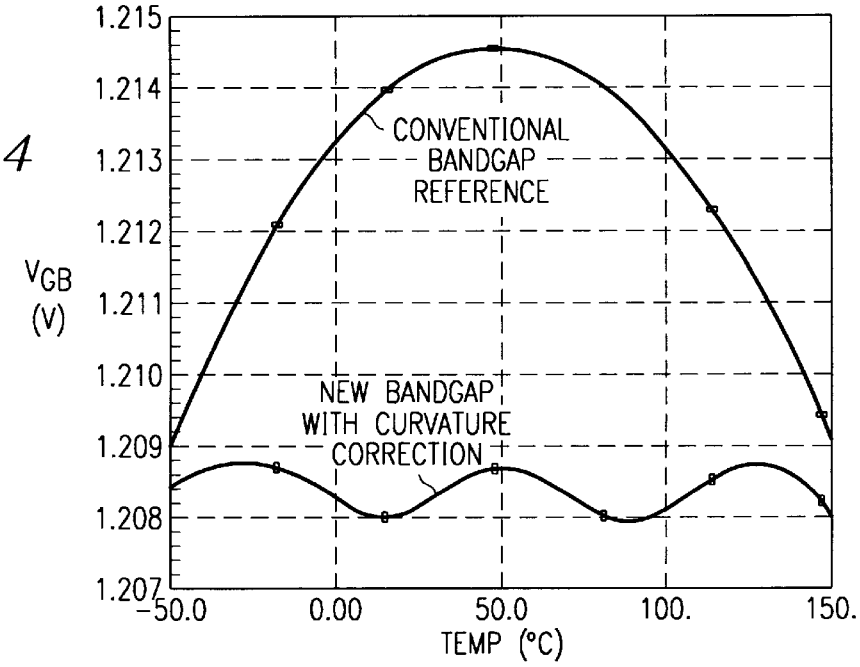
FIG. 4 shows a compensated bandgap voltage $V_{GB}$ in comparison with a convention bandgap voltage $V_{GB}$.

FIG. 4 illustrates the resultant bandgap voltage for a circuit that approximates three segments (two breakpoints). More breakpoints would lead to even better results. For the purpose of comparison, a convention bandgap reference is also plotted in FIG. 4. As can be seen in the figure, the conventional bandgap reference varies almost 6 mV over the temperature range. The new bandgap with curvature correction, on the other hand, varies less than one millivolt.

For the purpose of comparison, both the conventional bandgap reference and the reference of the present invention were simulated based on optimal trimming. In more typical conventional circuits, the bandgap voltage is controlled by ±12 mV due to process variations. It can also be expected that a circuit of the present invention, when considering process variations, will ±3 mV. Lower variations can be obtained by using more breakpoints. For example, testing has shown that a circuit that includes four breakpoints can be used to generate a bandgap voltage that varies less than one millivolt.

Figure 5:
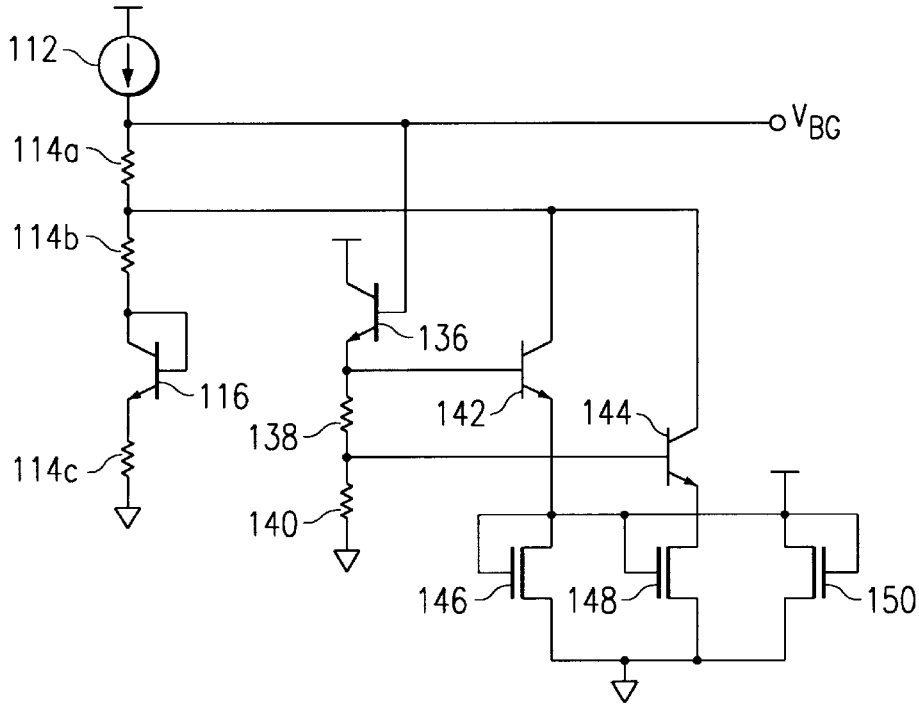
FIG. 5 shows a second embodiment circuit of the present invention.

FIG. 5 illustrates a more specific embodiment bandgap reference circuit. In this figure, current source 112 is once again illustrated schematically. Resistor 114 has been implemented using three resistors 114*a*–114*c*. Diode 116 is a bipolar transistor coupled to as to operate as a diode.

In the embodiment, the temperature detection circuit (e.g., element 134 in FIG. 2*b*) is implemented with bipolar transistor 136 and resistors 138 and 140. The switches 128–132 of FIG. 2*a* are implemented with bipolar transistors 142 and 144. The additional current sources are implemented with transistors 146, 148 and 150. While only two such additional sources are shown in the figure, it should be recognized that any number of additional current sources can be included. Since each additional current source requires only two transistors, the cost in terms of real estate is minimal.

The resistors 138 and 140 can be implemented using a polysilicon strip or a lightly doped well within another semiconductor region (e.g., the substrate). With this implementation, the number of resistive sections (e.g., resistors 138, 140) can be increased by including additional contacts within the strip or well.

Resistors 138 and 140 form a resistor ladder such that the voltage at the base of switch 142 is greater than the voltage at the base of switch 144. As a result, switch 142 will start conducting first. As transistor 136 becomes more conductive, the voltage as the base of transistor 144 will go up until transistor 144 is also conductive. As transistors 142 and 144 become conductive, additional current will be provided to the bandgap portion of the circuit thereby providing further compensation.

FIGS. 6*a*–6*c*, collectively FIG. 6, illustrate a more specific embodiment of the present invention. As with FIG. 5, this embodiment utilizes a resistor ladder to approximate the bandgap curve as a function of temperature with three portions. As labeled in the figure, this circuit includes a bandgap circuit 152, a start up and prebias for the bandgap circuit 154 and a temperature sensor and high order temperature correction circuit 156. The start up circuit is included to ensure that the bandgap circuit stabilizes at the desired bandgap voltage since the circuit will also be stable with an output of zero volts.

It is noted that the circuit of FIGS. 6 can be designed to include a trimming circuit. For example the preferred embodiment includes either six or seven trim bits that can be used to tune the circuit.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of generating a substantially constant voltage, the method comprising:

providing a bandgap reference circuit including a first current source;

trimming the bandgap reference circuit such that a voltage output from the bandgap reference circuit is at its peak value when an operating temperature is at its minimum value within a specified operating temperature range; and providing a plurality of additional current sources to the bandgap reference circuit, each current source designed to successively provide additional current as the operating temperature increases within the specified operating temperature range.

2. The method of claim 1 wherein providing a plurality of additional current sources comprises providing more than two additional current sources.

3. The method of claim 1 wherein the specified operation temperature range comprises a temperature range between about −50° C. and 150° C.

4. The method of claim 1 wherein providing a bandgap reference circuit comprises providing a bandgap reference circuit that is compensated with first order temperature correction.

5. The method of claim 1 wherein the method of generating a substantially constant voltage comprises generating a voltage that varies less than about one millivolt as temperature changes over the specified operating temperature range.

* * * * *